US007178764B2

(12) United States Patent
Klein

(10) Patent No.: US 7,178,764 B2
(45) Date of Patent: Feb. 20, 2007

(54) DEVICE FOR OPERATING RAIL SWITCHES

(75) Inventor: Herbert Klein, Zeltweg (AT)

(73) Assignees: VAE Eisenbahnsysteme GmbH, Zeltweg (AT); VAE GmbH, Vienna (AT)

( * ) Notice: Subject to any disclaimer, the term of this patent is extended or adjusted under 35 U.S.C. 154(b) by 0 days.

(21) Appl. No.: 10/485,164

(22) PCT Filed: Jun. 26, 2002

(86) PCT No.: PCT/AT02/00184

§ 371 (c)(1),
(2), (4) Date: Jan. 28, 2004

(87) PCT Pub. No.: WO03/011671

PCT Pub. Date: Feb. 13, 2003

(65) Prior Publication Data

US 2005/0139729 A1 Jun. 30, 2005

(30) Foreign Application Priority Data

Jul. 31, 2001 (AT) ..... GM606/2001

(51) Int. Cl.
*E01B 7/00* (2006.01)

(52) U.S. Cl. ..... 246/257; 246/449; 246/450

(58) Field of Classification Search ..... 246/382, 246/384, 257, 260, 274, 258, 458, 449, 450, 246/452, 448; 188/316
See application file for complete search history.

(56) References Cited

U.S. PATENT DOCUMENTS 2,893,718 A * 7/1959 McGowan ..... 267/128
4,045,008 A * 8/1977 Bauer ..... 267/120
4,799,577 A * 1/1989 de Carbon ..... 188/277
5,292,091 A 3/1994 Callegari et al.
6,354,541 B1 * 3/2002 Achleitner et al. ..... 246/448

FOREIGN PATENT DOCUMENTS

| | | |
|---|---|---|
| AT | 401 256 B | 7/1996 |
| DE | 195 25 012 A1 | 9/1996 |
| EP | 0 779 197 A1 | 6/1997 |
| WO | WO 96/00160 | 1/1996 |
| WO | WO 96/34786 | 11/1996 |

* cited by examiner

*Primary Examiner*—Mark T. Le
(74) *Attorney, Agent, or Firm*—Chapman and Cutler LLP

(57) ABSTRACT

In a device for operating rail switches, in which a plurality of mutually coupled hydraulic operating devices are arranged in an offset manner in the longitudinal direction of the rails, the cylinder-piston units of the hydraulic operating devices are connected to be driven in the same direction. The working volumes (13) of the hydraulic cylinder piston units (7) each comprise two regions (18, 19) with defined cylinder cross sections, wherein the respective regions (18) containing end-position securing means (20, 21), safety locking means and/or sensors, of the cylinder-piston units (7) arranged in an offset manner in the longitudinal direction of the rails have equal cross sections and the respective other regions (19) of the cylinder-piston units (7) arranged in an offset manner in the longitudinal direction of the rails have cross sections differing from one another. (FIG. 6)

19 Claims, 4 Drawing Sheets

DEVICE FOR OPERATING RAIL SWITCHES

DEVICE FOR OPERATING RAIL SWITCHES

The invention relates to a device for operating rail switches, in which a plurality of mutually coupled hydraulic operating devices are arranged in an offset-manner in the longitudinal direction of the rails and the cylinder-piston units of the hydraulic operating devices are connected to be driven in the same direction. Such a device has, for instance, become known from WO 96/00160.

When operating rail switches, the deplacement paths, which differ along the longitudinal direction of the rail, will in principle have to be taken into consideration. The necessary displacement path is the smaller the nearer the site of application of the respective cylinder-piston unit to the fixing point of the tongue rail. Moreover, different actuating forces, which will rise with the distance to the fixing point of the tongue rail decreasing, have to be taken into account. This is due to the lever principle as well as to the fact that the cross section of a tongue rail is smaller in a region remote from the fixing point of the tongue rail than in a region neighboring the fixing point. In order to adjust the respectively required displacement stroke of the hydraulic cylinder-piston unit, it was proposed in WO 96/00160 to arrange push-open valves within the piston stroke of the hydraulic cylinder-piston unit in the duct connecting the two working volumes of the cylinder-piston unit, for instance, in the form of a piston bore. Depending on the position of the piston, this connection is either interrupted or provides fluid communication, whereby it is feasible to reach the desired position in a precise manner. This enables the synchronous hydraulic movement of the mutually coupled hydraulic cylinder-piston units arranged in an offset manner along the longitudinal direction of the rail.

From German Offenlegungsschrift No. 21 44 564 an alternative proposal for the adjustment of the required path-dependent shift has become known, according to which cylinder pistons having identical dimensions are used for a hydraulic switch actuator, wherein a structural component in which the respectively required empty run is adjustable is arranged between the cylinder and the associated switch tongue. However, this calls for complex mechanical installations, and hence considerably increases the structural expenditures required for the operating device. As can be taken from WO 96/00160, and is also known from EP 0 778 191, the cross sections of the respective hydraulic cylinders can be changed in order to adjust a displacement stroke that decreases along the longitudinal direction of the rails with the vicinity to the fixing point of the switch tongue increasing. This involves, however, the problem of a operating device being comprised of a plurality of hydraulic cylinders having different cross sections such that the installation of operating devices of this type will be very cumbersome on account of the plurality of different dimensions. Also the manufacture and assembly of the hydraulic cylinders will involve elevated expenditures, since all parts connected with the hydraulic cylinder-piston unit, or all parts arranged within the cylinder such as, for instance, end-position securing means, safety locking means and/or sensors, too will have to be adapted to said different dimensions. Even the assembly dimensions of the differently dimensioned hydraulic cylinders will vary accordingly, thus additionally complicating the assembly procedure.

The present invention aims to provide a device for operating rail switches, which enables the precise adjustment of the displacement paths and actuating forces required in each case, while allowing the assembly dimensions of the hydraulic cylinders to remain unchanged and the diversity of parts of the hydraulic units required for the operating device to be kept as low as possible. To solve this object, the invention consists essentially in that the working volumes of the hydraulic cylinder piston units each comprise two regions with defined cylinder cross sections, wherein the respective regions containing end-position securing means, safety locking means and/or sensors, of the cylinder-piston units arranged in an offset manner in the longitudinal direction of the rails have equal cross sections and the respective other regions of the cylinder-piston units arranged in an offset manner in the longitudinal direction of the rails have cross sections differing from one another. Due to the fact that the individual hydraulic cylinders may be regarded as divided into two functional regions, it becomes feasible to effect the cross-sectional change of the cylinder required for the respective stroke adjustment only in one of the two regions, in which a minimum of other cylinder-piston unit components has to be taken into account. Thus, the end-position securing means, safety locking means and/or sensors are provided in the first region, which has an identical cross section in all of the cylinder-piston units arranged along the longitudinal direction of the rails, so that these structural components can be designed with identical dimensions and manufactured in a simple manner by series production. In addition, this will facilitate the installation of such means in the hydraulic cylinder, since the same tools can be used in all cases. The other region of the cylinder-piston units is designed to have each a different cross section in order to enable the displacement stroke to be adapted to the respective conditions differing along the longitudinal direction of the rails. At the same time, it is feasible to optimize the respectively required actuating forces, higher actuating forces acting on the tongue with the distance to the fixing point of the switch tongue decreasing. The precise adaptation of the piston stroke causes the remaining fluid volume to be substantially lowered and hence the internal hydraulic losses of the operating device to be considerably reduced.

In a preferred manner, the configuration is further developed such that the region containing end-position securing means, safety locking means and/or sensors has a smaller cross section than the other region. It is thereby feasible to arrange in an advantageous manner the end-position securing means and/or safety locking means provided in the respective region, thus enabling the realization of a particularly small-structured device.

Although the adjustment of the respectively required piston stroke is already feasibly in an extremely precise manner by the above-mentioned measures, additional means may be provided in a preferred manner to carry out fine adjustments. To this end, the configuration is further developed such that the working volumes of the cylinder-piston unit communicate with each other via a bore of the piston and that push-open valves are arranged in said bore. As known per se, the working volumes of a cylinder-piston unit in such a case are connected with each other through a duct formed by a bore with push-open valves being incorporated. These valves are actuated by a tappet firmly connected with the cylinder so as to open the duct connecting the two working volumes of the cylinder and preventing any further displacement of the piston.

By the piston stroke changing with the respectively different cylinder cross section, also the overall structural length of the cylinder-piston unit will naturally change such that special measures will have to be taken in order to safeguard consistent assembly dimensions of the actuating cylinders. To this end, the configuration is advantageously further developed such that the cylinder is connected with a coupling flange with a spacer being interposed, wherein the length of the spacer corresponds to the stroke reduction brought about by the increased cross section of the cylinder. The spacers, thus, bridge the small overall structural length of the cylinder caused by the reduced stroke, so that the installation situation and the application situation for the rod assembly will remain the same and the assembly dimensions of the device will be identical along the entire tongue rail. Adaptations of those parts which are connected with the hydraulic cylinders can thereby be reduced to a minimum so that the expenditures involved in the installation of the same will be considerably reduced.

In the following, the invention will be explained in more detail by way of an exemplary embodiment schematically illustrated in the drawing. Therein, FIG. 1 is a top view on a partial region of a rail switch;

Figure 1:
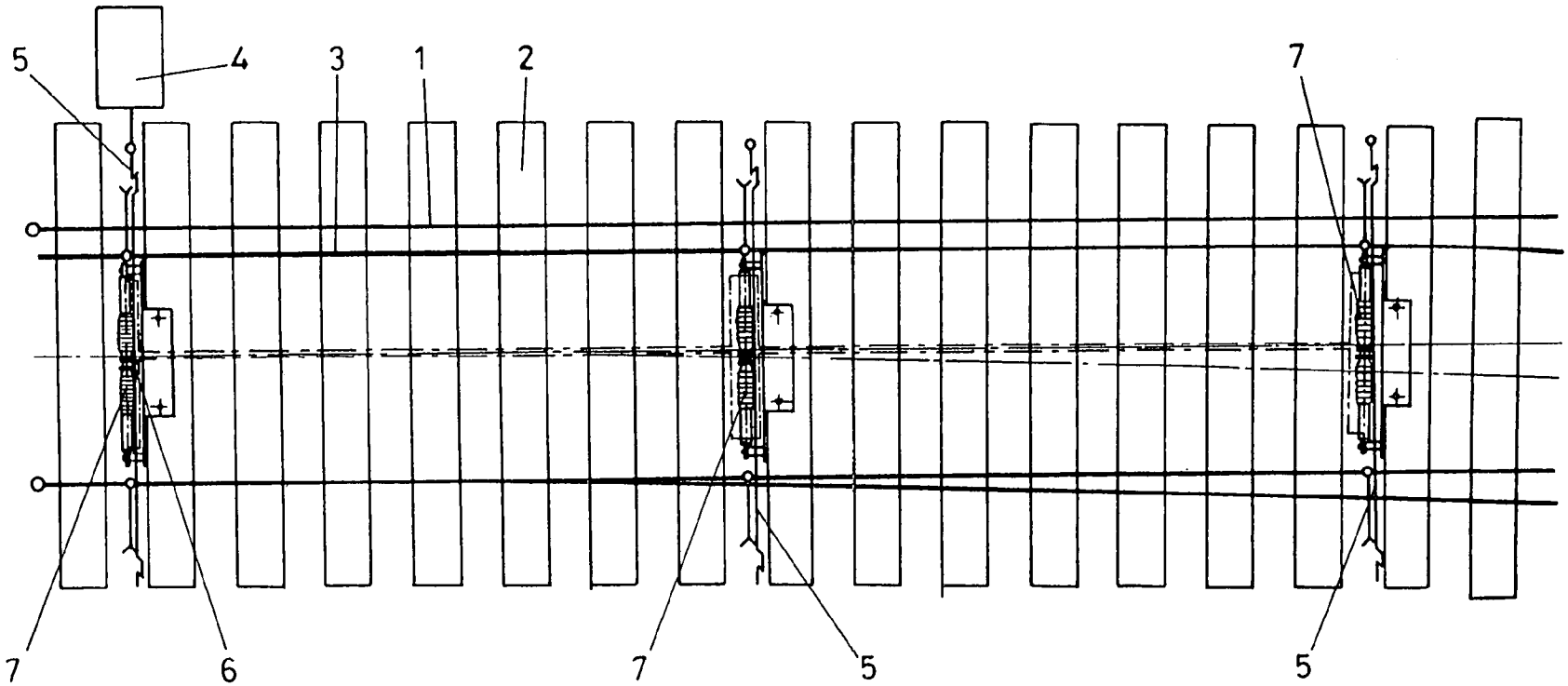
Figure 2:
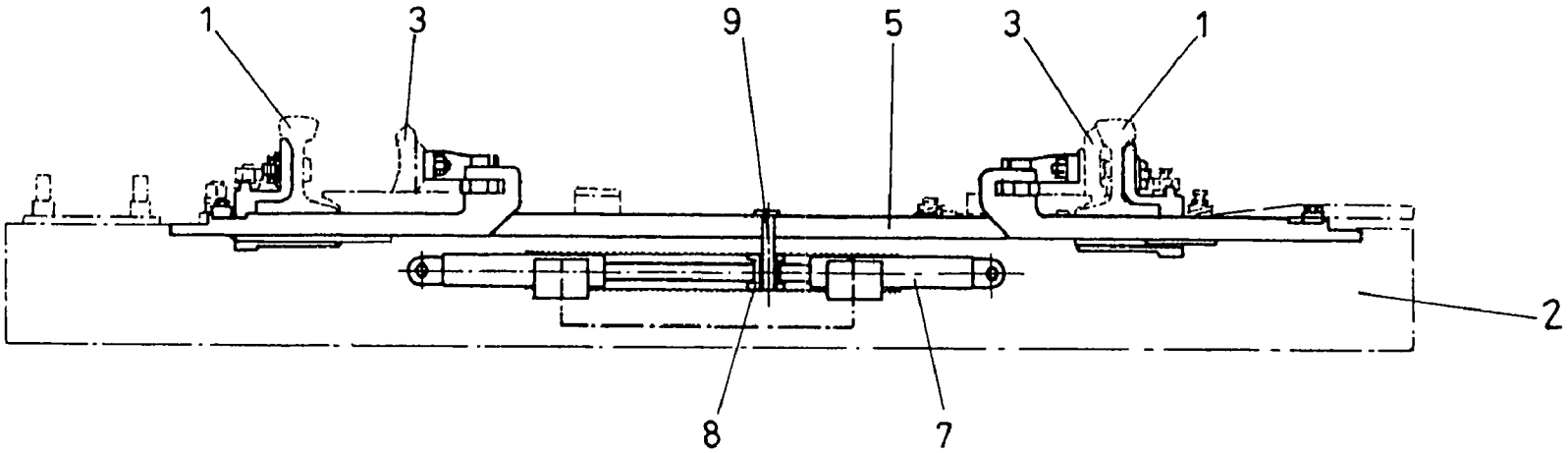
FIG. 2 Prior Art
FIG. 2 shows a detail of the connection of a conventional cylinder-piston unit including a mechanical push rod.
Figure 3:
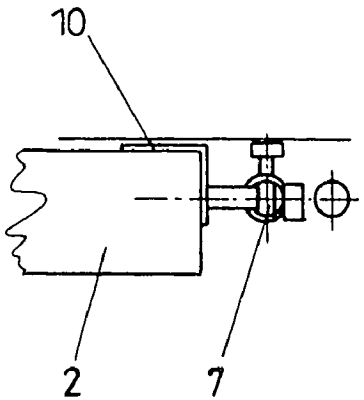
FIG. 3 Prior Art
FIG. 3 is a schematic partial view of the illustration according to FIG. 2.

In FIG. 1, rails 1 are schematically indicated, which are connected with sleepers 2. In the region of a switch, tongue rails 3 are provided in addition to the standard rails 1 and capable of being brought into their respective position by the aid of an actuating drive schematically denoted by 4. The actuating drive 4 acts on the tongue rails 3 via push rods 5. The push rods 5 are coupled with a hydraulic cylinder-piston unit 7 via a central tap 6. Furthermore, additional cylinder-piston units 7 are to be seen in the rail course, which are each coupled with push rods and locking means again schematically denoted by 5. From the illustration according to FIG. 2, the type of mechanical connection of the hydraulic cylinder-piston units 7 with the push rods 5 is more clearly apparent. The cylinder-piston units 7 each comprise a sliding block 8 in which a pin 9 of the push rod 5 engages. By actuating the push rod 5, the sliding block, and hence the piston of the hydraulic cylinder-piston unit, are being displaced, thus causing fluid to be pressed out of the respective working volume. FIG. 3 elucidates the type of fixation of the hydraulic cylinder-piston unit 7 to the sleeper 2. Said fixation is effected via a stop plate 10 fixed to the sleeper 2. The hydraulic cylinder-piston units 7 consequently require relatively little space so that the packing of the substructure will not be affected.

Figure 4:
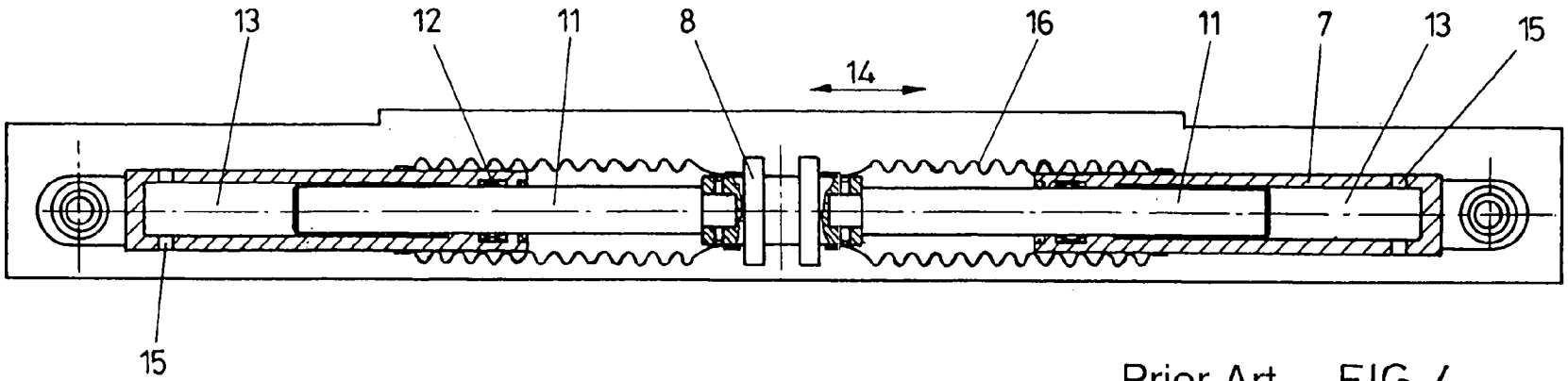
FIG. 4 Prior Art
FIG. 4 is a partially sectioned, enlarged illustration of a conventional hydraulic cylinder-piston unit.
Figure 5:
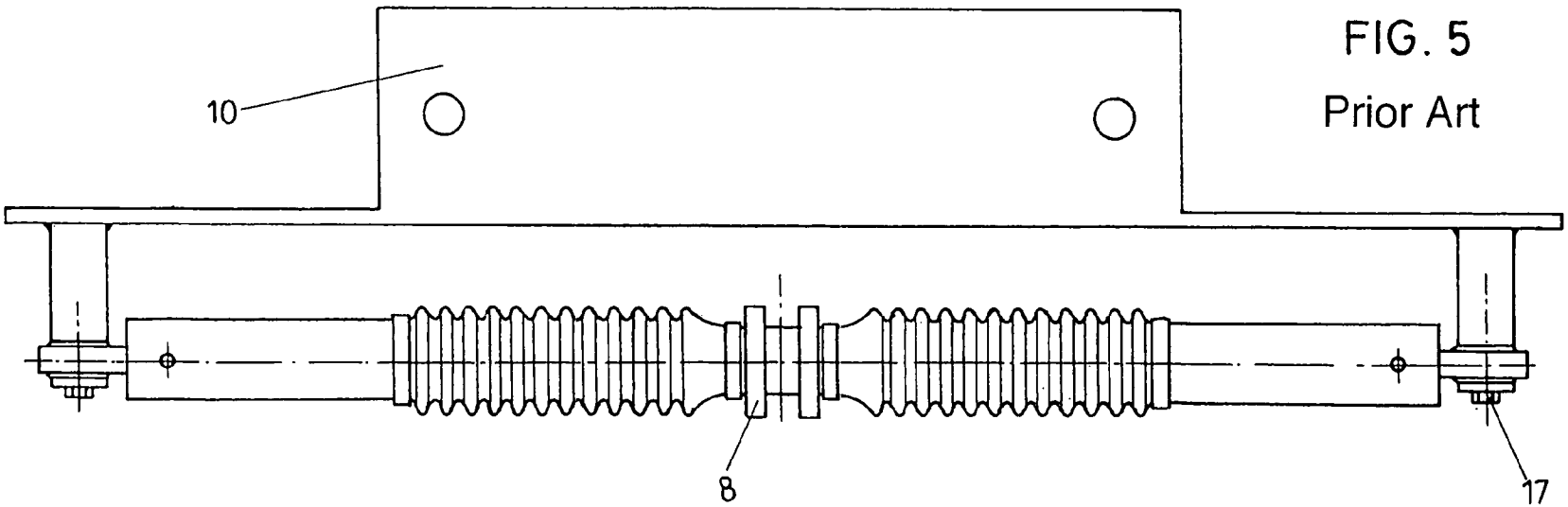
FIG. 5 Prior Art
FIG. 5 is a top view on the illustration of FIG. 4.

The mode of functioning of the hydraulic cylinder-piston units and their preferred configuration are explained in more detail by way of FIGS. 4 and 5. A hydraulic cylinder-piston unit 7 comprising a plunger 11 is apparent from FIGS. 4 and 5. Plungers 11 immerse into the respective working volumes 13 of the hydraulic cylinder-piston units via seals 12, medium being each pressed out of the respective working volume 13 at a displacement of the plunger 11 in one of the directions of double arrow 14. The hydraulic connections run to the externally provided openings 15 in the respective working volume 13. The sliding block realizing the mechanical coupling is again denoted by 8. Furthermore, a rubber sleeve 16 is provided for the protection of the device.

From FIG. 5, the device according to FIG. 4 is apparent in top view.

Figure 6:
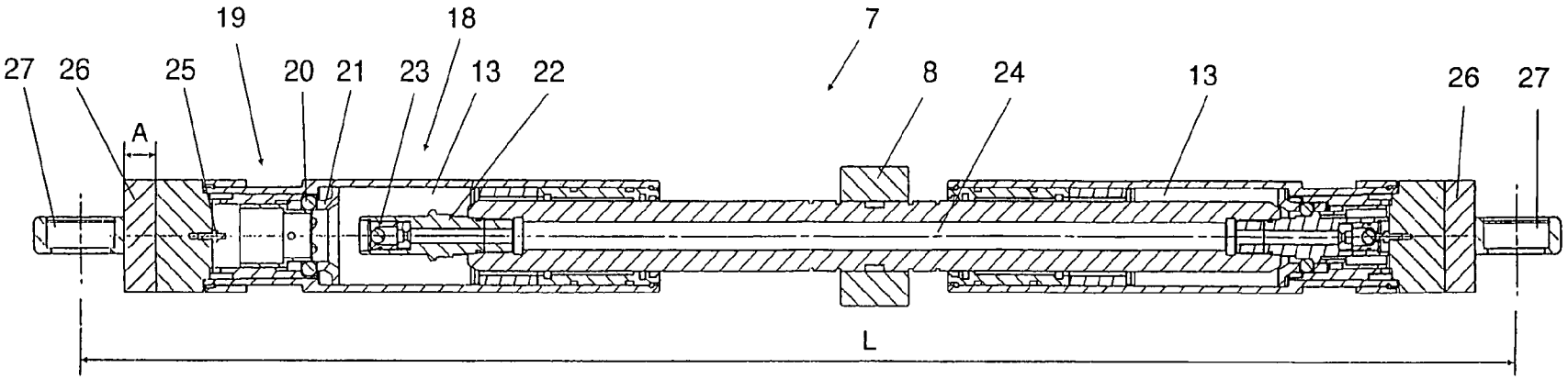
FIG. 6 is a sectional illustration of a hydraulic piston-cylinder unit used according to the invention.

The individual hydraulic cylinder-piston units are coupled to one another and arranged in an offset manner in the longitudinal direction of the rail, the first hydraulic cylinder-piston unit acting as a pumping element for the consecutive cylinder-piston units. To this end, the working volumes 13 of the first hydraulic piston-cylinder unit 7, which acts as a pumping element, are connected with the respective working volumes 13 of neighboring hydraulic cylinder-piston units 7 via the hydraulic duct, the connection being realized in a manner that at a displacement of the first hydraulic cylinder-piston unit, which acts as a pumping element, all the other hydraulic cylinder-piston units will be coupled to a displacement in the same sense. If cylinder-piston units arranged in parallel or in series are to travel a distance different from that covered by the hydraulic cylinder-piston unit used as a pumping element, the cross sections of the individual cylinder-piston units will have to be influenced accordingly, to which end the hydraulic cylinders according to FIG. 6 will be employed. The working volume 13 of the cylinder-piston unit 7 in a first region 18 is designed to have a cross section identical with those of all other cylinder-piston units arranged in an offset manner in the longitudinal direction of the rails. In a region 19, the working volume is designed to have an enlarged cross section, the cylinder cross sections of the cylinder-piston units arranged in an offset manner in the longitudinal direction of the rails differing from one another in this region in order to adjust the respectively required piston stroke. In the region 18, end-position securing means and/or safety locking means are arranged. The end-position securing means comprises ball-shaped locking organs 20 received in a driving sleeve 21. The locking organs 20 cooperate with stop shoulders formed on a piston end piece 22 fastened to the piston 11. A push-open valve 23 is arranged in the piston end piece 22 for closing and opening the bore 24 axially passing through the piston 11 and connecting the two working volumes 13. The push-open valve is actuated by a projection formed, for instance, by a pin 25 and attached to the bottom of the cylinder, whereby the fluid of the hydraulic actuating drive is able to pass through the bore 24 into the respective other working volume, thus impeding any further movement of the piston. A number of structural components having constant cross sections are, thus, arranged in the region 18 such that no adaptation of these structural components to the different cross sections of the region 19 will be required.

In order to keep the installation length of the hydraulic cylinder-piston units equal in any displacement plane, a spacer 26 is provided, which is arranged between the hydraulic cylinder and a coupling flange 27. By appropriately choosing the length A of the spacer 26, the installation length L is kept constant such that, in the main, the same fastening situation for the reception of the cylinder-piston units will be met in all of the displacement planes.

The invention claimed is:

1. A device for operating rail switches, comprising at least a first hydraulic operating device and a second hydraulic operating device, said first hydraulic operating device and said second hydraulic operating device being mutually coupled and arranged in an offset manner in a longitudinal direction of rails, wherein said first hydraulic operating device comprises a first cylinder-piston unit (7) and said second hydraulic operating device comprises a second cylinder-piston unit (7), said first cylinder-piston unit and said second cylinder-piston unit being driven in the same direction, wherein working volumes (13) of the first cylinder-piston unit (7) and of the second cylinder-piston unit (7) each comprise a first region (18) and a second region (19) with defined cylinder cross sections, and the first region (18) contains end-position securing means (20,21), and the first regions (18) of the first cylinder-piston unit (7) and the first regions (18) of the second cylinder-piston unit (7) have equal cross sections, and the second regions (19) of the first cylinder-piston unit (7) have cross sections different from corresponding cross sections of the second regions (19) of the second cylinder-piston unit (7).

2. A device according to claim 1, wherein the first regions (18) have smaller cross sections than the second regions (19).

3. A device according to claim 1, wherein the working volumes (13) of at least one of said first and second cylinder-piston units (7) communicate with each other via a bore (24) of a piston (11) of the cylinder-piston unit (7), and push-open valves (23) are arranged in said bore (24).

4. A device according to claim 1, wherein a cylinder of at least one of said first and second cylinder-piston units (7) is connected with a coupling flange (27) with a spacer (26) being interposed, wherein a length (A) of the spacer (26) corresponds to stroke reduction brought about by increased cross section of the cylinder.

5. A device according to claim 1, wherein the first regions (18) comprise safety locking means.

6. A device according to claim 1, wherein the first regions (18) comprise sensors.

7. A device according to claim 1, wherein the first regions (18) comprise safety locking means and sensors.

8. A device according to claim 5, wherein the first regions (18) have smaller cross sections than the second regions (19).

9. A device according to claim 6, wherein the first regions (18) have smaller cross sections than the second regions (19).

10. A device according to claim 7, wherein the first regions (18) have smaller cross sections than the second regions (19).

11. A device according to claim 2, wherein the working volumes (13) of at least one of said first and second cylinder-piston units (7) communicate with each other via a bore (24) of a piston (11) of the cylinder-piston unit (7), and push-open valves (23) are arranged in said bore (24).

12. A device according to claim 5, wherein the working volumes (13) of at least one of said first and second cylinder-piston units (7) communicate with each other via a bore (24) of a piston (11) of the cylinder-piston unit (7), and push-open valves (23) are arranged in said bore (24).

13. A device according to claim 6, wherein the working volumes (13) of at least one of said first and second cylinder-piston units (7) communicate with each other via a bore (24) of a piston (11) of the cylinder-piston unit (7), and push-open valves (23) are arranged in said bore (24).

14. A device according to claim 7, wherein the working volumes (13) of at least one of said first and second cylinder-piston units (7) communicate with each other via a bore (24) of a piston (11) of the cylinder-piston unit (7), and push-open valves (23) are arranged in said bore (24).

15. A device according to claim 2, wherein a cylinder of at least one of said first and second cylinder-piston units (7) is connected with a coupling flange (27) with a spacer (26) being interposed, wherein a length (A) of the spacer (26) corresponds to stroke reduction brought about by increased cross section of the cylinder.

16. A device according to claim 3, wherein a cylinder of at least one of said first and second cylinder-piston units (7) is connected with a coupling flange (27) with a spacer (26) being interposed, wherein a length (A) of the spacer (26) corresponds to stroke reduction brought about by increased cross section of the cylinder.

17. A device according to claim 5, wherein a cylinder of at least one of said first and second cylinder-piston units (7) is connected with a coupling flange (27) with a spacer (26) being interposed, wherein a length (A) of the spacer (26) corresponds to stroke reduction brought about by increased cross section of the cylinder.

18. A device according to claim 6, wherein a cylinder of at least one of said first and second cylinder-piston units (7) is connected with a coupling flange (27) with a spacer (26) being interposed, wherein a length (A) of the spacer (26) correspond s to stroke reduction brought about by increased cross section of the cylinder.

19. A device according to claim 7, wherein a cylinder of at least one of said first and second cylinder-piston units (7) is connected with a coupling flange (27) with a spacer (26) being interposed, wherein a length (A) of the spacer (26) corresponds to stroke reduction brought about by increased cross section of the cylinder.

* * * * *